US009712914B1

(12) United States Patent
Hoops et al.

(10) Patent No.: US 9,712,914 B1
(45) Date of Patent: Jul. 18, 2017

(54) COSTUME COORDINATED, MOTION ACTIVATED SOUND GENERATION SYSTEM

(71) Applicant: GeekNet, Inc., Fairfax, VA (US)

(72) Inventors: Hilary Hoops, Fairfax, VA (US); Tyson Liotta, Rockville, MD (US)

(73) Assignee: Geeknet, Inc., Fairfax, VA (US)

( * ) Notice: Subject to any disclaimer, the term of this patent is extended or adjusted under 35 U.S.C. 154(b) by 0 days.

(21) Appl. No.: 14/010,489

(22) Filed: Aug. 26, 2013

Related U.S. Application Data

(60) Provisional application No. 61/693,134, filed on Aug. 24, 2012.

(51) Int. Cl.
*H04R 1/00* (2006.01)
*H04R 3/00* (2006.01)

(52) U.S. Cl.
CPC ..... *H04R 3/00* (2013.01)

(58) Field of Classification Search
CPC ..... A63H 3/28; A63H 2200/00; A63H 13/00; A63H 11/00; A63H 33/18; A63H 5/00; A63H 33/22; A63H 30/00; A63H 30/04; A63H 33/006; A63H 3/02; A63H 3/04; A63H 3/50; A63H 11/02; A63H 11/06; A63H 11/12; A63H 11/18; A63H 13/02; A63H 13/04; H04M 2250/02; H04M 1/7253; H04R 5/02; H04R 1/46; H04R 2201/023; H04R 2225/41; H04R 2430/01; H04R 25/356; H04R 25/453; H04R 25/50; H04R 25/505
USPC ..... 381/333, 321, 67
See application file for complete search history.

(56) References Cited

U.S. PATENT DOCUMENTS

| | | | | |
|---|---|---|---|---|
| 6,150,947 | A * | 11/2000 | Shima | A63H 5/00 340/692 |
| 2005/0159072 | A1* | 7/2005 | Brown | A41D 1/002 446/26 |
| 2010/0144239 | A1* | 6/2010 | Eck | A63H 13/00 446/330 |
| 2014/0106642 | A1* | 4/2014 | Irmler | A63G 31/00 446/338 |

* cited by examiner

*Primary Examiner* — Akelaw Teshale
(74) *Attorney, Agent, or Firm* — Womble Carlyle Sandridge & Rice, LLP; David Scott Sudderth

(57) ABSTRACT

The disclosure describes a costume coordinated, motion activated sound generation system, including apparatuses and methods, for generating pre-defined audio in connection with a costume worn by a user and the type, extent, and rate of movements by the user. According to an example embodiment, the system comprises an electronic controller having a memory for storing pre-defined audio data associated with the type, forcefulness, and rate of a user's movements and having an audio interface and speaker for generating audio from such audio data. The system also comprises one or more accelerometers or sensors for enabling detection of the type, extent, and/or rate of user movements. Based in part on the type, forcefulness, and rate of such movements, the system retrieves audio data corresponding thereto from memory and causes playback thereof, creating the illusion that the character, person, or thing being played by the user while in costume produced the sounds.

19 Claims, 4 Drawing Sheets

COSTUME COORDINATED, MOTION ACTIVATED SOUND GENERATION SYSTEM

CROSS REFERENCE TO RELATED APPLICATION

This application claims the benefit of priority to and incorporates herein by this reference in its entirety, U.S. provisional patent application Ser. No. 61/693,134, which is entitled "Costume Coordinated, Motion Activated Sound Generation System" and filed on Aug. 24, 2012.

FIELD OF THE INVENTION

The present invention relates, generally to the field of systems, including apparatuses and methods, for human entertainment and, more particularly including, costumes or disguises worn by people in connection with various activities, events, or occasions.

BACKGROUND

For many years, people have often celebrated special days such as Halloween, Christmas, Easter and birthdays by donning costumes and attending parties or other gatherings with other people who may or may not also be wearing costumes. People have also entertained themselves and others by donning costumes and participating in activities or events including trick-or-treating, parades, special movie-related events, or fan club meetings. Generally, such costumes have focused on visually altering the wearers' appearance to others by making the wearers appear to be someone who or something that they are not. For example, for Halloween, such a costume might cause the wearer to appear to be a scary character or thing such as a monster, vampire, witch or ghost, a cartoon or comic book character such as Wonder Woman, Superman, Spiderman, or the Incredible Hulk, a person then in the public spotlight such as a politician, entertainer, athlete or hero, a person associated with a particular occupation such as a doctor, nurse, or clown, an animal such as a gorilla, horse, or chicken, or even a normally inanimate or non-living object or thing such as a machine, beverage bottle, or cloud. Similarly, for Christmas or Easter, such a costume might cause the wearer to appear to be Santa Claus, Mrs. Claus, or the Easter Bunny.

Regardless of the particular type of costume, activity or event, costumes have typically included clothing or other similar articles worn over the wearers' trunk and limbs. Such costumes have also included disguises, masks or makeup worn over or on the wearers' head, face, and/or other body parts. However, while engaging the visual senses of others in the presence of the costumes' wearers, such costumes have generally failed to engage others' non-visual senses such as hearing, smell, or taste. By failing to engage one or more of these non-visual senses, the costumes sometimes also fail to achieve their maximum effect or impression on others.

Therefore, there is a need for a device or system for use in connection with a costume that improves the costume's effectiveness and overall impression by engaging one or more of the other senses of those persons in the presence of the costume's wearer and that changes the way in which such persons perceive the costume's wearer.

SUMMARY

Broadly described, the present invention comprises a costume coordinated, motion activated sound generation system, including apparatuses and methods, for use by a user while in costume and that detects the type, extent, and/or rate of movements of the user's body and produces audio associated therewith and in response thereto. According to an example embodiment and without limitation, the costume coordinated motion activated sound generation system comprises an electronic controller having a memory for storing pre-defined banks of audio data associated with the type, forcefulness, and rate of a user's movements and having an audio interface and speaker for generating audio from such audio data. The system also comprises one or more accelerometers or sensors for enabling detection of the type, extent, and/or rate of user movements. In operation, based in part on the bank of audio data selected by the user and on the type, forcefulness, and rate of detected user movements, the system retrieves audio data corresponding thereto from memory and causes the generation of audio therefrom.

Advantageously, because the audio is created almost simultaneously with the user's movements, the system creates the illusion that the user (or, more particularly, the character, person, or thing being played by the user while in costume) produced the sounds, thereby enhancing the costume's effectiveness and overall impression on others. Additionally, because audio data for various sound effects, ambient sounds, background noise, and/or music is stored in the controller's memory and because the controller produces audio corresponding to such sound effects, ambient sounds, background noise, and/or music whether the user moves or not, the system may create a desired ambiance surrounding the costumed user that is appropriate for the costume type.

Other uses, advantages, and benefits of the present invention may become apparent upon reading and understanding the present specification when taken in conjunction with the appended drawings.

DETAILED DESCRIPTION

Figure 1:
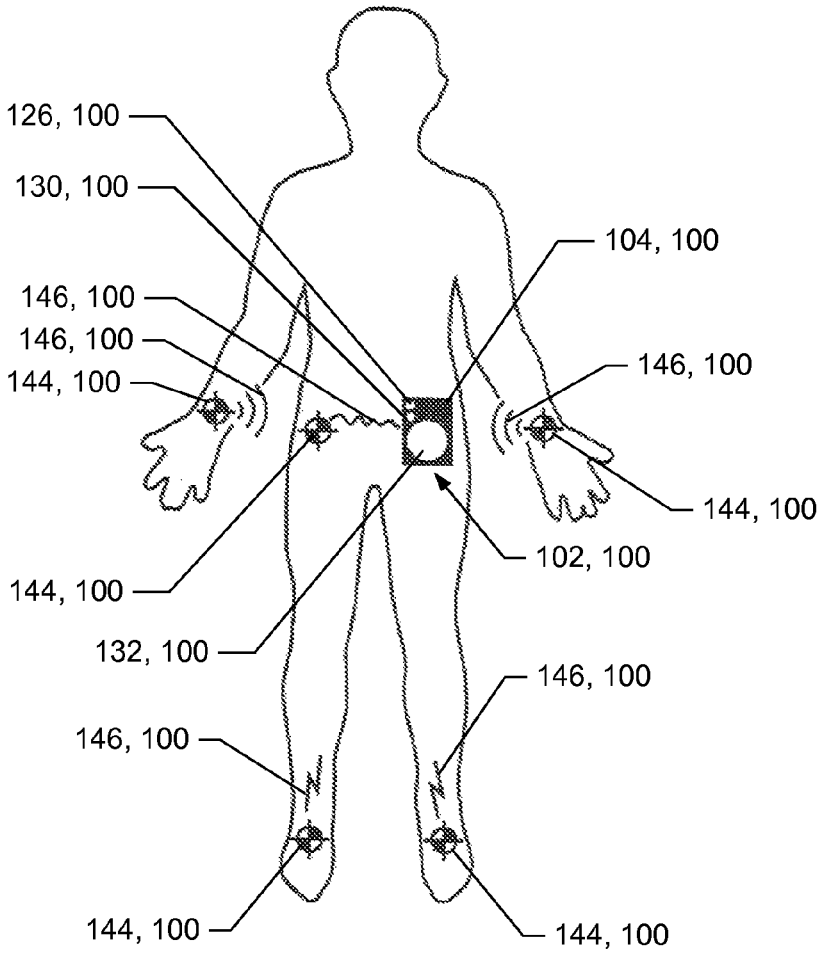
FIG. 1 displays a front, elevational, pictorial view of a costume coordinated, motion activated, sound generation system in accordance with example embodiments of the present invention.

Referring now to the drawings in which like numerals represent like elements or steps throughout the several views, FIG. 1 displays a costume coordinated, motion activated, sound generation system 100 (sometimes referred to herein as the "system 100") according to the example embodiments described herein. The system 100 is for use in connection with a costume worn by a user to improve the costume's effectiveness and overall impression by timely producing audible sounds that are coordinated with the costume and with the user's movements while wearing the costume. Generally, the system 100 is worn by or removably secured to the user under a costume such that when the user moves, the system 100 instantaneously detects the movement, identifies the "type" (for example and without limitation, movement of the user's torso, arm, leg, foot, and/or other body part), "extent" (for example, but not limited to, the forcefulness of a movement), and/or "rate" (for example and without limitation, the frequency of a movement) of the movement, and audibly generates a sound that is associated and coordinated with the particular type, extent, and/or rate of the movement and that is substantially simultaneous with the movement. The generated sound corresponds to audio data that has been previously stored in a memory component of the system 100 by the system's manufacturer, the user, or a party intermediate to the manufacturer and user.

One example of the system's use is in connection with a user wearing a costume creating the visual perception that the user is a giant robot. As the user walks, the system 100 detects the user's movement and generates audible sounds corresponding to booming mechanical footsteps timed in unison with the user's steps as if the giant robot were stomping through a city. In producing the sounds, the system 100 also detects the forcefulness or rapidity with which the user moves and generates different sounds based on the extent or rate of the movement. Thus, if the user steps down harder or stomps a foot, the system 100 generates audible sounds related to the forceful impact of the user's foot that are different than those created when the user walks normally. For example, the system 100 may generate the sound of a car being crushed when the system 100 detects a forceful downward motion of the user's foot. Similarly, as the user moves an arm or turns his/her head, the system 100 detects the user's movements and generates audible sounds corresponding to the type of movement including, for example and without limitation, the sounds of mechanical gears engaging and disengaging. Through the generation of audible sounds coordinated with the user's costume and movements, the system 100 engages the hearing senses of people in the user's presence in addition to their visual senses, thereby improving the costume's overall impression and effectiveness.

According to the various example embodiments, the system 100 comprises an electronic controller 102 that a user positions relative to his/her body and, typically, under a costume worn by the user. The controller 102 may be, for example, positioned by clipping the controller 102 onto the user's belt, by fastening the controller 102 to the user's clothing, or by other methods. The controller 102 includes an enclosure 104 and a printed circuit board (not visible) housed by the enclosure 104 and having a processing unit 106 and other electronic components appropriate to provide the system 100 with the functionality described herein.

Figure 2:
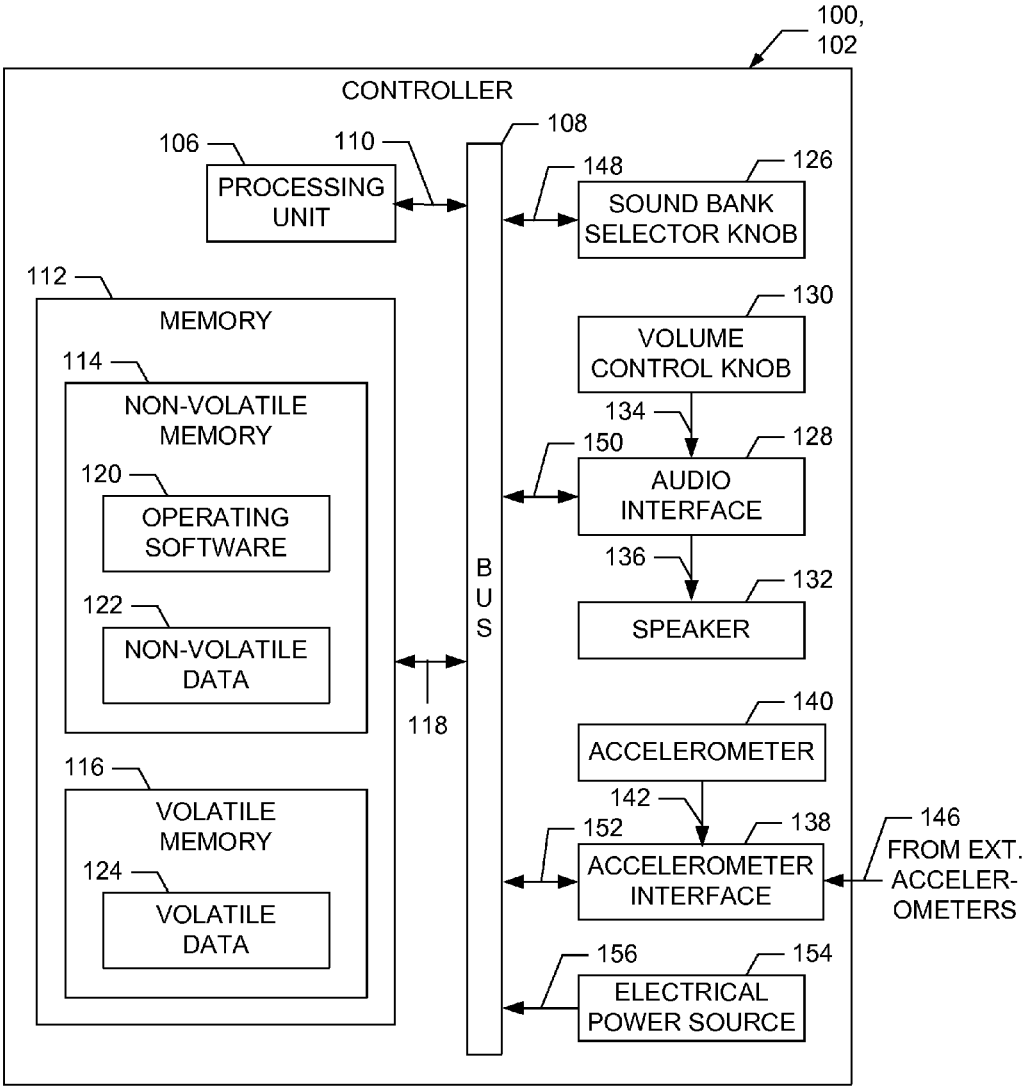
FIG. 2 displays a block diagram representation of a controller of the costume coordinated, motion activated, sound generation system of FIG. 1.

FIG. 2 displays a block diagram representation of the controller 102 according to the example embodiments. The controller 102 comprises a processing unit 106 that is communicatively connected to a bus 108 via signal paths 110 for the bi-directional communication of data with other components of the controller 102. The processing unit 106 is adapted to execute computer software instructions, causing the controller 102 and system 100 to perform as described herein. The processing unit 106 may comprise a microprocessor, microcontroller, arithmetic logic unit (ALU), application specific integrated circuit (ASIC), or other similar electronic device having similar capabilities, alone or in combination. The bus 108 comprises a plurality of bi-directional communication paths for the bi-directional communication of computer software instructions, address, data and various control signals necessary for operation of the controller 102.

The controller 130 also comprises a memory 112, including non-volatile memory 114 and volatile memory 116. The memory 112 is communicatively connected to bus 108 for the bi-directional communication of computer software instructions, address, data and control signals with the bus 108 and other device components connected to the bus 108, through one or more bi-directional signal paths 118. The memory 112 may, in whole or in part, reside with the processing unit 106 on a microcontroller chip or comprise one or more separate, discrete components or devices.

Non-volatile memory 114 generally stores information and/or data that will not be lost when electrical power to the non-volatile memory 114 is removed. Examples of non-volatile memory 114 include, without limitation, flash random access memory devices, battery backed up random access devices, read only memory devices, programmable read only memory devices, electrically programmable read only memory devices, universal serial bus (USB) devices, magnetic disks, optical disks, and other similar or non-similar devices or media available now or in the future. Volatile memory 116 typically stores information and/or data for a temporary period of time, as such information and/or data that will be lost when electrical power is no longer supplied to the volatile memory 116. Examples of volatile memory 116 include, but are not limited to, non-battery backed up random access memory devices.

According to the example embodiment, non-volatile memory 114 stores a plurality of computer software instructions of operating software 120 that, when delivered to and executed by processing unit 106, cause the processing unit 106 and other controller components to perform various actions and provide the basic functionality necessary to implement and support the methods and operations described herein. Execution of the plurality of computer software instructions of the operating software 120 also enables and causes the controller 106 and system 100 to provide the sounds associated, or not associated with (such as, for example, ambient or background sounds), with a costume worn by a user of the system 100 and to perform according to the methods herein. For example, execution of the operating software 120 causes the controller 106 to receive signals and/or data representative of the movement, or lack thereof, of a user's body, arms, legs, and/or feet from the system's accelerometers 140, 144 and to identify the movement, or lack thereof, and the rate of any such movement. Execution of the operating software 120 also causes the controller 106 to produce pre-defined sounds according to the operating software 164 in response to detecting a particular type or rate of movement, by generating and communicating analog electrical signals to the controller's speaker 132 which cause the speaker 132 to produce one or more sounds appropriate for the user's movement. Additionally, execution of the operating software 120 causes the controller 106 to produce no sound when the user has made no detected movement.

In addition to the operating software 120, non-volatile memory 114 stores non-volatile data 122 that is used by the processing unit 106 during execution of the operating software 120. Such non-volatile data 122 includes, without limitation, audio data representative of digitized audible sounds that is stored in groups, or banks, of sounds (also referred to herein as "sound banks") selectable through user input via the controller's sound bank selector knob 126. Each sound bank typically comprises, but is not limited to, audio data corresponding to a particular type of costume and to (a) introductory sounds, (b) multiple types and/or rates of user movements (for example, the taking of steps, stomping, or running), (c) no user movement, and/or (d) background or ambient sounds. Generally, a user selects a sound bank of sounds in connection with a particular type of costume being worn by the user and, based on the user's input, the controller 102 generates sounds during operation using audio data from the selected sound bank.

In some embodiments, the non-volatile memory 114 may be pre-loaded with non-volatile audio data furnished by a costume's manufacturer, distributor, or vendor. In other embodiments, the non-volatile memory 114 may be removable from the system's controller 102 and be replaceable with a different non-volatile memory 114 pre-loaded with audio data for use with a particular costume, thereby enabling the same system controller 102 and other components to be used with different costumes. In still other embodiments, the non-volatile memory 114 may be loaded by the user with similar audio data via downloading of audio data selected by the user from, for example, an Internet website. In yet other embodiments, the non-volatile memory 114 may include a combination of pre-loaded audio data and downloaded audio data. Additionally, the non-volatile memory 114 may include audio data corresponding to other sound effects, noise, and/or music that may or may not be related to a costume being worn by the user.

Volatile memory 116 stores volatile data 124 that is created and/or used by the controller 102 during execution of the operating software 120. Volatile data 116 may include, for example, audio data retrieved from non-volatile memory 114 for temporary use, data corresponding to and/or representative of user movements and/or signals received from accelerometers 140, 144, data corresponding to and/or representative of signals to be generated and communicated to the speaker 132, and/or data corresponding to and/or representative of the results of a calculation, intermediate data, and/or other information and/or data.

The controller 102, in accordance with the example embodiment, also comprises a sound bank selector knob 126, an audio interface 128 and volume control knob 130 and speaker 132 electrically and communicatively connected thereto via respective signal paths 134, 136, an accelerometer interface 138, and one or more, single or multiple axis internal accelerometers 140 electrically and communicatively connected thereto via signal path 142. In some example embodiments, one or more, single or multiple axis external accelerometers 144 (see FIG. 1) located in the user's costume or secured to the user's body, arms, legs, and/or feet are electrically and/or communicatively connected to the accelerometer interface 138 by wired or wireless communication paths 146. For wireless communications, the communication paths 146 may use, without limitation, visible light, infrared light, ultrasonic sound waves, or radio frequency waves to communicate signals. The sound bank selector knob 126, audio interface 128, and accelerometer interface 138 are electrically and communicatively connected, respectively and appropriately, to bus 108 by signal paths 148, 150, and 152.

The sound bank selector knob 126 receives user input and produces a signal in response thereto corresponding to a sound bank for use by the system 100 with a costume. The sound bank is selected by the user through rotation of the sound bank selector knob 126.

The audio interface 128 generally receives encoded audio data from processing unit 106, through signal paths 110, 150 and bus 108, corresponding to and/or representative of introductory sounds, sounds associated with the user's movements or non-movement, ambient noise, music, and/or sound effects, to be produced by the controller 102. The audio interface 128 decodes and/or decompresses such encoded audio data, as necessary or appropriate, and produces analog electrical signals corresponding thereto that are delivered to the speaker 132 by signal paths 136 to cause the speaker 132 to produce appropriate sounds at appropriate times and for appropriate durations. The audio interface 128 comprises a digital signal processor and/or hardware codec and related components according to the example embodiment herein, and may comprise a discrete component(s) as shown or may be part of a microcontroller chip. However, it should be understood and appreciated that a software-implemented codec may be used in other embodiments. It should also be understood and appreciated that while audio interface 128 is adapted to process encoded audio data, the audio interface 128 is also adapted process non-encoded audio data that may be associated with certain audio or sounds.

The volume control knob 130 receives user input and produces a signal in response thereto corresponding to a volume level for use by the audio interface 128 in producing electrical signals representative of audio data for the speaker 132. The volume level is selected by the user through rotation of the volume control knob 130. The volume control knob 130 may also serve as an off/on switch to turn the controller 102 off or on if rotated sufficiently in one angular direction or the other.

The accelerometer interface 138 receives input data and/or signals from the internal accelerometer 140 via signal path 142 and external accelerometers 144 via communication paths 146, corresponding to movements of the user's body, arms, legs, and/or feet. Upon receipt of such data and/or signals, the accelerometer interface 138 generates data representative thereof in a form appropriate for use by processing unit 106 and communicates such data to processing unit 106 via signal paths 152, 110 and bus 108. The processing unit 106 may store the accelerometer data in volatile memory 116 as volatile data 124 for subsequent use in identifying the type and rate of a user's movements and, in connection with the user's sound bank selection, for retrieving appropriate audio data corresponding thereto from non-volatile memory 114 for communication to the audio interface 128 to cause the subsequent generation of sounds or audio.

Additionally, the controller 102 comprises an electrical power source 154 connected to bus 108 via signal path 156 that supplies electrical energy to the various components of the controller 102. The electrical power source 154 generally includes one or more rechargeable or non-rechargeable batteries for storing and supplying the electrical energy.

Although not shown, the controller 102 may further include a display device for providing the user with visually displayed information related to the controller's operation and for user interaction with the controller 102. Such user interaction may include, for example and not limitation, the downloading of or management of audio data stored in non-volatile memory 114 as non-volatile data 122 and programming or set up of the controller 102 to produce particular sounds in connection with different types and/or rates of user movements. In some embodiments, such functions may be provided through various combinations and operations of other types or forms of user interfaces.

In accordance with the example embodiments and as described above, the system 100 comprises one or more, single or multiple axis internal accelerometers 140 present within the controller's enclosure 104 and one or more, single or multiple axis external accelerometers 144 secured to the user's costume or body, arms, legs, and/or feet using straps, clips, hook and loop fasteners, and other devices or methods. The accelerometers 140, 144 produce electrical signals in response to the user's movements. The produced electrical signals provide input to the processing unit 106 for the detection and identification of the type and/or rate of the user's movements. As an alternative or in addition to such accelerometers, the controller 102 may include one or more force sensor(s) or other sensing device(s) electrically and/or communicatively connected to the accelerometer interface 138 that are similarly responsive to the user's movements and that similarly produce electrical signals corresponding thereto.

To use the system 100, a user may need to initially configure the system 100 for operation with the user's costume type. If the system 100 comprises a system embodiment that comes pre-loaded with audio data corresponding to the user's costume type that is already identified for certain types, extents, and/or rates of user movements and for other sounds, then no configuration is necessary. However, if the system 100 comprises a system embodiment that is not pre-loaded with such audio data, that permits selection and association of certain sounds with certain types, extents, and/or rates of user movements, that allows replacement of the controller's memory device with an alternate memory device for the user's particular costume, or that requires downloading of audio data from the costume vendor's Internet website for use with the costume, the user must configure the system 100 with audio data corresponding to types, extents, and/or rates of user movements and, if desired, with audio data associated with special effects, ambient sounds, background noise, or music.

After the system 100 is appropriately configured, the user positions the controller 102 adjacent and in contact with the user's body. Often such positioning may be accomplished by clipping the controller 102 to the user's belt or pants top and, hence, adjacent the user's torso. Alternatively, such positioning may be accomplished by securing the controller 102 adjacent the user's torso with a strap, hook and loop fastener, or other method. Once the controller 102 is so positioned, the user turns on the controller 102 through actuation of the volume control knob 130. Depending on the particular system embodiment being used, the user then secures one or more external accelerometer(s) 144 (or, alternatively, force sensor(s) or sensing device(s)) adjacent his/her torso, clips external accelerometers 144 (or, alternatively, force sensor(s) or sensing device(s)) to his/her shoes, and/or secures external accelerometers 144 (or, alternatively, force sensor(s) or sensing device(s)) in various other body locations including, for example, the user's arms, legs, or head. The user then activates the accelerometer(s) 144 (or, alternatively, force sensor(s) or sensing device(s)) and puts his/her costume on.

With the controller 102 and external accelerometers 144 (or, alternatively, force sensor(s) or sensing device(s)) powered on and operating, each time the user moves a body part whose movement is detected by the internal accelerometer 140 or an external accelerometers 144 (or, alternatively, force sensor(s) or sensing device(s)), the controller 102 receives signals from such device(s) corresponding to such movement via respective communication links 140, 146. Using the received signals, the controller 102 determines the type of movement made by the user and the extent (for example, is the user walking normally or stomping) of such movement. If similar movements have been recently made, the controller 102 also determines the rate or frequency of such movement. By determining the rate or frequency of movement, the controller 102 can determine, for instance, if the user is walking or is running. Based upon such determinations, the controller 102 retrieves audio data from non-volatile memory 114 corresponding to the type, extent, and/or rate of the movement and produces appropriate electrical audio signals that are converted into audible sounds by the controller's speaker 132. During the creation of such audible sounds, the controller's display device (if any) may display information indicating the sounds or group of sounds being produced, thereby providing the user with visual feedback that the appropriate sounds are being used.

Because the audible sounds are created almost simultaneously with the user's movement(s), the system 100 creates the illusion that the user (or, more particularly, the character, person, or thing being played by the user while in costume) produced the sounds, thereby enhancing the costume's effectiveness and overall impression on others. Additionally, if audio data for various sound effects, ambient sounds, background noise, and/or music is present in the controller's non-volatile memory 114 and if the controller 102 is configured to produce audible sounds corresponding to such sound effects, ambient sounds, background noise, and/or music whether the user moves or not, the system 100 may create a desired ambiance surrounding the costumed user that is appropriate for the costume type.

Figure 3A:
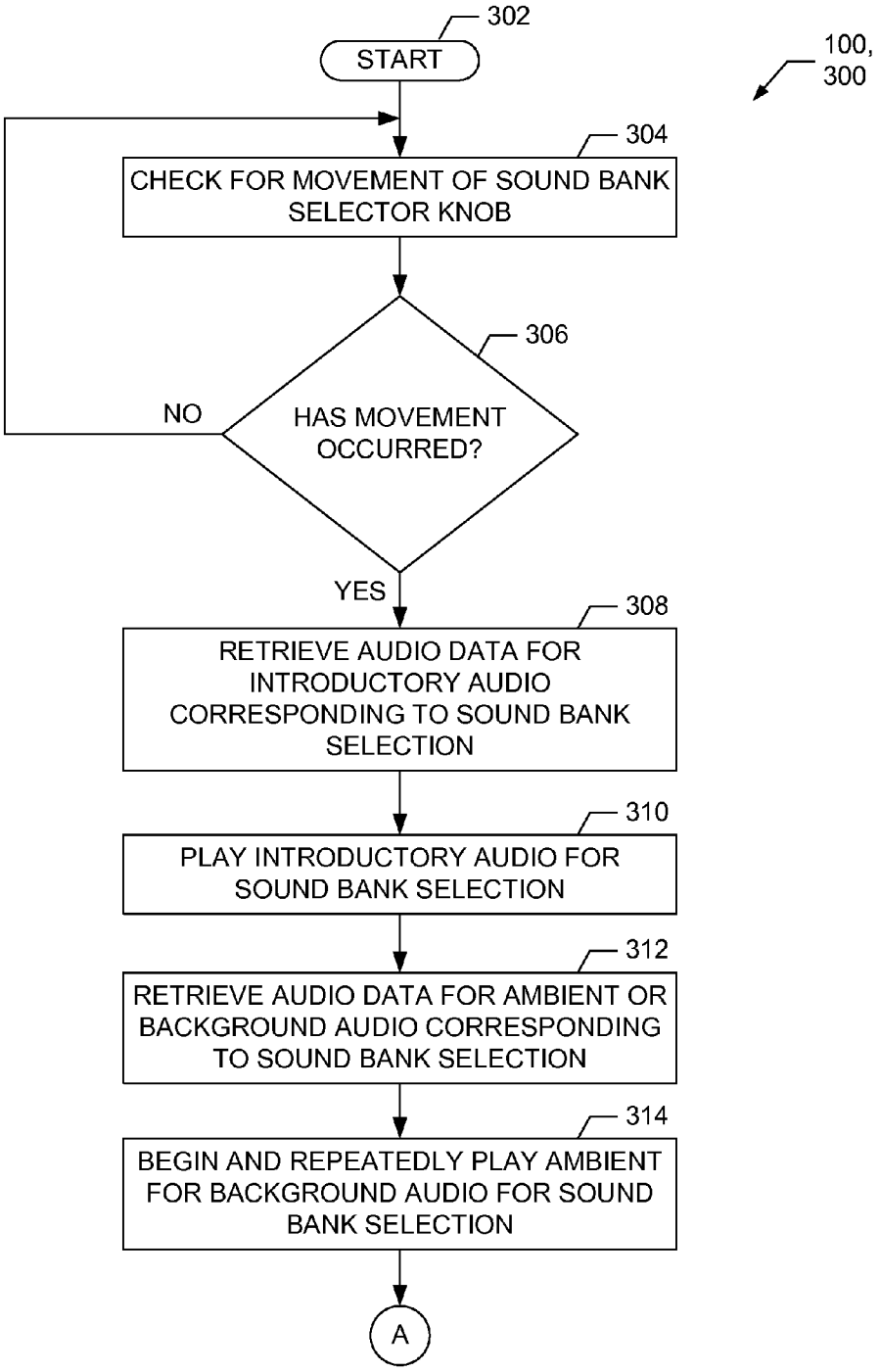
FIGS. 3A and 3B display a flowchart representation of a method of operation of the costume coordinated, motion activated, sound generation system of FIG. 1.
Figure 3B:
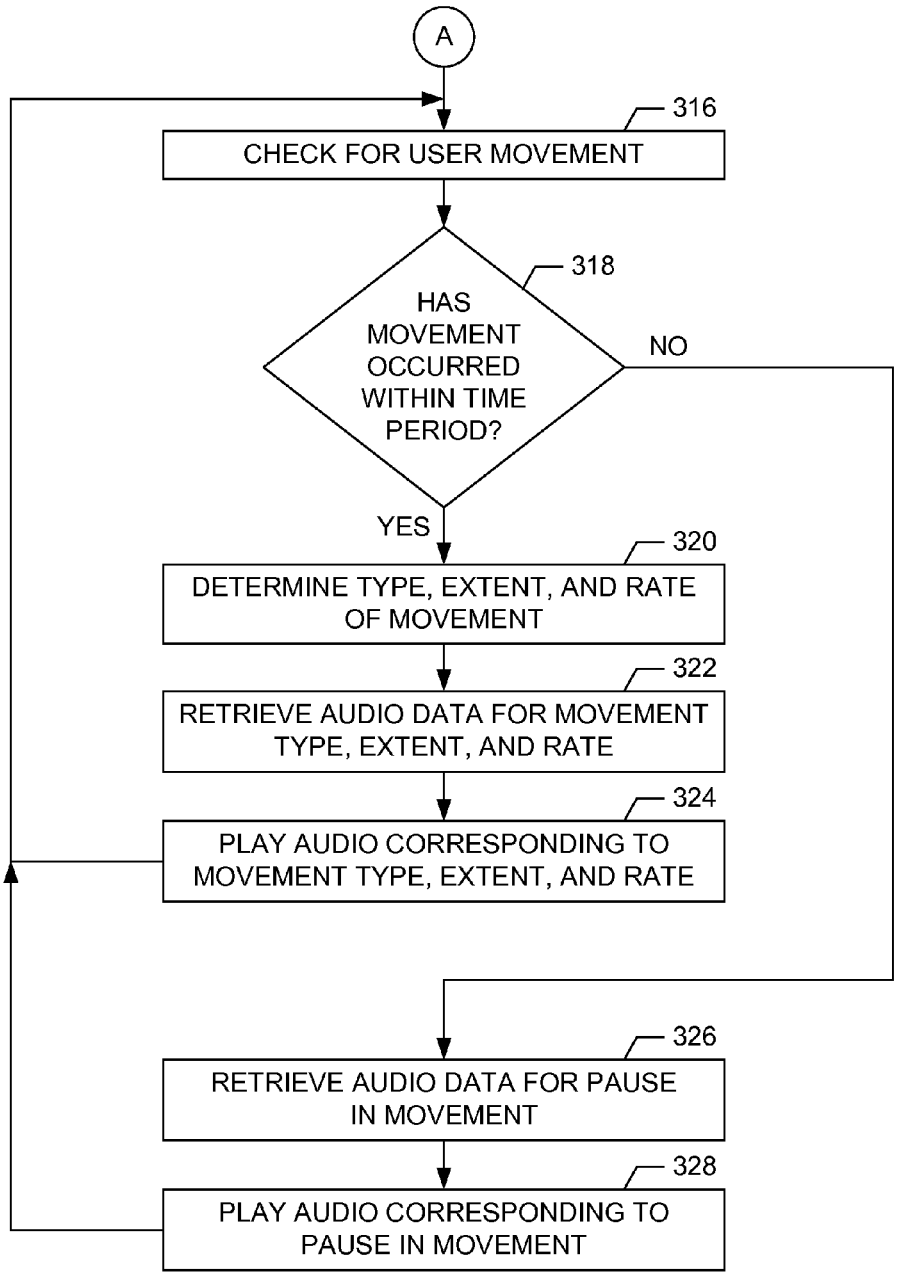

FIGS. 3A and 3B displays a flowchart representation of a method 300 of operation of the system 100 according to the example embodiments. After starting at step 302, the system 100 advances to step 304 where the processing unit 106 checks for movement of the sound bank selector knob 126 to determine if the user has selected a sound bank for use with his/her costume. At step 306, if no movement of the knob 126 has occurred, the processing unit 106 loops back to step 304 to again check for movement of the sound bank selector knob 126. If movement of the knob 126 has occurred, the user has selected a sound bank and the processing unit 106 proceeds to step 308 where the processing unit 106 retrieves audio data from non-volatile memory 114 for the introductory audio to be played upon selection of the sound bank by the user. Then, at step 310, the processing unit 106 causes playing of the introductory audio via the audio interface 128 and speaker 132.

After the introductory audio has been played, the processing unit 106 continues at step 312 of method 300 where the processing unit 106 retrieves audio data from non-volatile memory 114 for the ambient or background audio corresponding to the sound bank selection by the user. Then, at step 314, the processing unit 106 causes playing of the ambient or background audio to begin and repeatedly be played in a looping manner via the audio interface 128 and speaker 132.

At step 316, the processing unit 106 checks for user movement (for example, of the user's torso, arms, legs, and/or feet) by collecting accelerometer data from the accelerometer interface 138. The processing unit 106 analyzes the collected accelerometer data at step 318 to determine if user movement has occurred within a pre-determined timeout period. If user movement has occurred, the processing unit 160 moves to step 320 of method 300 where it determines the type, extent, and/or rate of such movement. Based at least on the sound bank selection and the type, extent, and/or rate of such movement, the processing unit 106 retrieves the audio data from non-volatile memory 114 corresponding to such movement at step 322. Then, at step 324, the processing unit 106 causes playing of the retrieved audio data for such movement via the audio interface 128 and speaker 132 while ambient or background audio or sound continues to be played in the background. After playing of the audio associated with such movement, the processing unit 106 loops back to step 316 to check for further user movement.

If, at step 318, the processing unit 106 determines that no user movement has occurred within a pre-determined timeout period, a pause in the user's movements is deemed to have occurred and the processing unit 106 branches to step 326 of method 300. At step 326, the processing unit 106 retrieves audio data from non-volatile memory 144 corresponding to the sound bank selection and a pause in the user's movement. Then, the processing unit 160 causes playing of the retrieved audio data associated with such pause via the audio interface 128 and speaker 132. Similar to the audio corresponding to a user's movement, the audio associated with a pause in the user's movement is played while ambient or background audio or sound continues to be played in the background. After playing of the audio corresponding to a pause in the user's movement, the processing unit 106 returns to step 316 to again check for further user movement. Operation of the system 100 continues according to method 300 until the volume control knob 130 is rotated into the "off" position.

Whereas the present invention has been described in detail above with respect to example embodiments thereof, it should be appreciated that variations and modifications might be effected within the spirit and scope of the present invention, as described herein before and as defined in the appended claims.

What is claimed is:

1. A system for producing sounds in connection with a costume worn by a user and corresponding to movements by the user, said system comprising:

a sensor worn by the user that detects movement of a portion of the body of the user and produces data representative of said detected movement; and a controller communicatively coupled to said sensor and having a memory storing pre-defined audio data for producing sounds corresponding to both the costume worn by the user and a respective plurality of types of movements made by the user while wearing the costume, wherein said controller receives said data representative of said detected movement from said sensor, identifies said detected movement as one type of movement of said plurality of types of movements, and further is adapted to determine forcefulness of the movement made by the user for retrieving from said memory pre-defined audio data corresponding to the costume and said type of movement, and at least in part on the determined forcefulness, and generates at least one sound associated with said type of movement and with the costume worn by the user.

2. The system of claim 1, wherein the costume comprises a first costume and said pre-defined audio data comprises first pre-defined audio data for producing sounds corresponding to the first costume and to a respective plurality of movements possibly made by the user while wearing the first costume, and wherein said memory additionally stores predefined audio data for producing sounds corresponding to a second costume and to a respective plurality of movements possibly made by the user while wearing the second costume.

3. The system of claim 2, wherein said controller further comprises a selector operable to receive user input identifying one of said first pre-defined audio data for producing sounds corresponding to the first costume or said second pre-defined audio data for producing sounds corresponding to the second costume.

4. The system of claim 3, wherein said controller is configured to retrieve from said memory said first pre-defined audio data or said second pre-defined audio data based at least in part on the received user input.

5. The system of claim 3, wherein said selector comprises a movable knob having a first position corresponding solely to said first pre-defined audio data and a second position corresponding solely to said second pre-defined audio data.

6. The system of claim 1, wherein the costume comprises a first costume and said pre-defined audio data comprises first pre-defined audio data for producing sounds corresponding to the first costume and to a respective plurality of movements possibly made by the user while wearing the first costume, and wherein said memory comprises a first memory replaceable by a second memory storing pre-defined audio data for producing sounds corresponding to both a second costume worn by the user and a respective plurality of movements possibly made by the user while wearing the second costume.

7. The system of claim 1, wherein said pre-defined audio data comprises predefined audio data downloaded to said memory via a communication network.

8. The system of claim 7, wherein the communication network comprises the Internet.

9. The system of claim 1, wherein said sensor comprises a force sensor.

10. The system of claim 1, wherein said sensor comprises a first sensor worn by the user on an arm for detecting movement of the arm and for producing data representative of said detected movement of the arm, and wherein said system further comprises a second sensor worn by the user on a leg for detecting movement of the leg and for producing data representative of said detected movement of the leg.

11. A system for producing audio corresponding to a costume worn by a user and to movements made by the user while wearing the costume, said system comprising:

an accelerometer configured to be worn by the user and for generating data corresponding to movements by the user;

a controller adapted to be worn by the user while wearing the costume and said accelerometer, said controller being communicatively coupled with said accelerometer and having a memory configured with pre-defined audio data associated with the costume and with respective movements possible by the user while wearing the costume, said controller being further adapted to retrieve pre-defined audio data corresponding to movements by the user and to produce sound from the retrieved pre-defined audio data, wherein said controller determines a type of movement made by the user and retrieves pre-defined audio data from said memory based at least in part on the determined type of movement; and wherein said controller is further adapted to determine forcefulness of a movement made by the user and to retrieve pre-defined audio data from said memory based at least in part on the determined forcefulness.

12. The system of claim 11, wherein said controller is further adapted to be worn by the user beneath the costume.

13. The system of claim 11, wherein said pre-defined audio data comprises a first bank of pre-defined audio data, wherein the costume is a first costume and said first bank of pre-defined audio is associated with the first costume, and wherein said memory is further configured with a second bank of pre-defined audio data associated with a second costume and with respective movements possible by the user while wearing the second costume.

14. The system of claim 13, wherein said controller is further adapted to receive input from the user causing said controller to retrieve pre-defined audio data from said first bank of pre-defined audio data or said second bank of pre-defined audio data.

15. The system of claim 11, wherein said controller is further adapted to determine a rate of movement made by the user and to retrieve pre-defined audio data from said memory based at least in part on the determined rate of movement.

16. The system of claim 11, wherein said memory comprises a first memory and wherein said system further comprises a second memory configured to replace said first memory, and wherein said second memory is configured with pre-defined audio data associated with a different costume and with respective movements possible by the user while wearing the different costume.

17. The system of claim 11, wherein said accelerometer comprises a first accelerometer configured to be worn by the user on a first body part and for generating data communicated to said controller and corresponding to movement of the first body part by the user, and wherein said system comprises a second accelerometer configured to be worn by the user on a second body part and for generating data communicated to said controller and corresponding to movement of the second body part by the user.

18. An article of clothing with a motion activated, sound generation system, comprising:

at least one sensor attached to the article of clothing worn by a user such that the at least one sensor is arranged along a prescribed location of the user's body, wherein the at least one sensor detects movement at the prescribed location of the user's body;

a controller communicatively coupled with the at least one sensor to receive data generated by the at least one sensor in response to movement by the user at the prescribed location of the user's body, the controller including a memory that stores predefined audio data corresponding to a series of sounds selected based on a set of possible types of movements by the user, wherein the controller determines a type of movement detected by the at least one sensor and a magnitude and a rate of the type of movement, and selects audio data corresponding to one or more of the series of sounds stored in the memory associated with the type of movement; and a speaker in communication with the controller, wherein in response to detection of movement by the user, the controller sends one or more control signals to the speaker so as to generate one or more sounds substantially corresponding to the type of movement, and wherein the one or more sounds vary based on the magnitude and frequency of the identified type of movement.

19. The article of clothing of claim 18, wherein the article of clothing is a shoe worn by the user, and wherein the speaker generates multiple sounds that vary based on whether the user is walking, running, stomping or combinations thereof.

* * * * *